US009499765B2

(12) United States Patent
Yamamoto et al.

(10) Patent No.: US 9,499,765 B2
(45) **Date of Patent: *Nov. 22, 2016**

(54) LUBRICATING OIL COMPOSITIONS FOR CONSTRUCTION MACHINES

(71) Applicant: Chevron Japan Ltd., San Ramon, CA (US)

(72) Inventors: Shuhei Yamamoto, Makinohara (JP); Masanobu Sakamoto, Kakegawa (JP)

(73) Assignee: Chevron Japan Ltd., San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/665,737

(22) Filed: Mar. 23, 2015

(65) Prior Publication Data

US 2016/0281022 A1 Sep. 29, 2016

(51) Int. Cl.
*C10M 161/00* (2006.01)

(52) U.S. Cl.
CPC ..... *C10M 161/00* (2013.01)

(58) Field of Classification Search
CPC ..... C10M 161/00
See application file for complete search history.

(56) References Cited

U.S. PATENT DOCUMENTS 5,922,657 A * 7/1999 Camenzind ..... C10L 1/10 508/430
6,225,266 B1 * 5/2001 Watts ..... C10M 141/10 508/193

* cited by examiner

*Primary Examiner* — Cephia D Toomer
(74) *Attorney, Agent, or Firm* — Carlton Virassammy

(57) ABSTRACT

The present invention is directed to a Zinc-free transmission oil composition for construction machinery comprising:

(i) a major amount of an oil of lubricating viscosity,
(ii) at least 0.25 wt. % of a dithiophosphorylated carboxylic acid compound, and
(iii) a succinimide dispersant derived from a polyisobutylene group of 1200 molecular weight or less.

Also provided is a method for lubricating the transmission of a construction machine comprising lubricating the transmission with a Zinc-free transmission oil composition comprising:

(i) a major amount of an oil of lubricating viscosity,
(ii) at least 0.25 wt. % of a dithiophosphorylated carboxylic acid compound, and
a succinimide dispersant derived from a polyisobutylene group of 1200 molecular weight or less.

17 Claims, No Drawings

LUBRICATING OIL COMPOSITIONS FOR CONSTRUCTION MACHINES

FIELD OF THE INVENTION

The present invention generally relates to lubricating oil compositions useful for transmissions, and particularly transmission oils for construction machines.

BACKGROUND OF THE INVENTION

Transmission oil for construction machines widely used in the world have been formulated with ZnDTP due to its multifunction in oxidation inhibition, corrosion prevention, and wear inhibition. Recent trend in downsizing the transmission to achieve better efficiency and lower cost generates a high pressure and high temperature environment in the transmission system. ZnDTP is known to decompose by reaction with water to form zinc polyphosphates, water soluble phosphate and alkyl sulfides, which is the cause of sludge formation. High pressure and high temperature environment can worsen the ZnDTP decomposition. Therefore, the presence of ZnDTP can cause clogging of the clutches under extraordinary surface pressure and high temperature conditions, which decreases friction coefficient.

The present invention relates to Zinc-free transmission oil for construction machinery. The lubricating oil composition exhibit both improved friction characteristics and extreme pressure performance even without ZnDTP.

In general, the following patent art teaches elements of the proposed invention, but none of them teach a dithiophosphorylated carboxylic acid compound in combination with a succinimide dispersant derived from a polyisobutylene group of 1200 molecular weight or less.

U.S. Pat. No. 6,225,266 teaches a Zinc-free lubricant composition for lubricating a continuously variable transmission, which comprises a mixture of a major amount of a lubricating oil and an effective amount of a performance enhancing additive combination comprising: (a) an ashless dispersant; (b) at least one organic phosphite; (c) a calcium detergent; (d) one or more friction modifiers selected from the group consisting of: succinimides and ethoxylated amines; and (e) a primary amide of a long chain carboxylic acid.

U.S. Pat. No. 6,337,309 teaches a zinc-free lubricating composition for lubricating a continuously variable transmission which comprises a mixture of a major amount of a lubricating oil and an effective amount of a performance enhancing additive combination comprising: (a) an ashless polyisobutenyl succinimide dispersant; (b) at least one organic thioether phosphite; (c) a calcium phenate overbased detergent at a concentration such that the total amount of calcium in the fluid is less than about 500 ppm; (d) friction modifiers comprising one or more succinimides and one or more ethoxylated amines; and (e) a primary amide of a long chain carboxylic acid.

US patent application number US20060276352 teaches a a lubricating composition containing (a) an oil soluble phosphorus amine salt; (b) about 0.0001 wt % to about 0.5 wt % of a metal containing detergent package comprising a phenate and a sulphonate; (c) a dispersant; (d) a dispersant viscosity modifier; (e) a metal deactivator; and (f) an oil of lubricating viscosity, wherein the lubricating composition contains less than about 0.25 wt % of a metal dialkyldithiophosphate.

US patent application number US20060264340 teaches a method of lubricating a dual clutch transmission employing a plurality of wet clutches by a lubricating fluid includes a base oil, a succinimide dispersant, a succinimide friction modifier, and a phosphonate.

U.S. Pat. No. 6,756,346 teaches a lubricating oil composition comprising (I) 100 pbw of a base oil, (II) an antiwear agent comprising (i) from 0.05 to 10 pbw of a phosphorothionate and from 0.01 to 1.0 pbw of an amine salt of phosphorus compound and/or (ii) from 0.05 to 10 pbw of a dithiophosphate, and (III) a rust preventing agent comprising from 0.01 to 1.0 pbw of an amide obtained by reacting a polyalkylene polyamine and a carboxylic acid having from 4 to 30 carbon atoms, and the use of such lubricating composition.

U.S. Pat. No. 5,942,470 teaches gear oil and gear oil additive concentrates of enhanced positraction performance, which comprise: (i) at least one oil-soluble sulfur-containing extreme pressure or antiwear agent; (ii) at least one oil-soluble amine salt of a partial ester of an acid of phosphorus; and (iii) at least one oil-soluble succinimide of specific structure. These compositions preferably contain one or more of the following additional components: (iv) at least one amine salt of a carboxylic acid; (v) at least one nitrogen-containing ashless dispersant; and (vi) at least one trihydrocarbyl ester of a pentavalent acid of phosphorus.

US patent application number US20100152078 teaches a lubricating oil composition comprising a sulfurized neopentyl glycol phosphate, a substituted succinimide, a reaction product of an alkyl dicarboxylic acid or anhydride and ammonia, a fatty amine ethoxylate, an oleamide, and dodecyl succinic acid.

European patent number EP1055722 teaches an oil composition for non-stage transmissions which is obtained by incorporating (b) a polymethacrylate, (c) the phenate or a sulfonate of an alkaline earth metal, (d) an imide compound, (e) an (alkyl)phenyl(thio)phosphate, (f) zinc dithiophosphate, and (g) a fatty acid amide compound into (a) a lube base oil.

U.S. Pat. No. 6,534,451 teaches a power transmission fluid composition comprising an ashless dispersant, a friction modifier, an antioxidant, a viscosity modifier and an antiwear agent which is the product formed by reacting elemental sulfur and a dialkylphosphite.

European patent number EP0769546 teaches a lubricating oil composition comprising a boron containing overbased material, a phosphorus compound, a borated friction modifier, a thiocarbamate and a dispersant viscosity modifier.

US patent application number US20040192562 teaches a lubricating oil composition which comprises calcium salicylate having a base number of 50 to 300 mgKOH/g in an amount of 0.005 to 0.07 percent by mass in terms of calcium, an SP type extreme pressure additive in an amount of 0.005 to 0.07 percent by mass in terms of phosphorous, one or more compounds selected from the group consisting of specific succinimide compounds below in an amount of 0.1 to 6 percent by mass, and a boron-containing ashless dispersant in an amount of 0.001 to 0.05 percent by mass in terms of boron, based on the total mass of the composition.

US patent application number US2014162919 teaches a lubricant composition for a full transmission system, comprising an ashless dispersant; a friction modifier; a phosphorus-containing antiwear agent; an antirust additive; a sulfur-containing extreme-pressure additive; a metal deactivation additive; a viscosity index improver; and a pour-point depressant.

It is therefore desirable for a Zinc-free transmission oil for construction machinery. The present invention is directed to a Zinc-free transmission lubricating oil composition which exhibit both improved friction characteristics and extreme pressure performance even without ZnDTP.

SUMMARY OF THE INVENTION

In accordance with one embodiment of the present invention, there is provided a Zinc-free transmission oil composition for construction machinery comprising:

(a) a major amount of an oil of lubricating viscosity, (b) at least 0.25 wt. % of a dithiophosphorylated carboxylic acid compound, and (c) A succinimide dispersant derived from a polyisobutylene group of 1200 molecular weight or less.

Also provided is a method for lubricating the transmission of a construction machine comprising lubricating the transmission with a Zinc-free transmission oil composition comprising:

(a) a major amount of an oil of lubricating viscosity, (b) at least 0.25 wt. % of a dithiophosphorylated carboxylic acid compound, and a succinimide dispersant derived from a polyisobutylene group of 1200 molecular weight or less.

DEFINITIONS

The following terms will be used throughout the specification and will have the following meanings unless otherwise indicated.

The term "a major amount" of a base oil refers to where the amount of the base oil is at least 40 wt. % of the lubricating oil composition. In some embodiments, "a major amount" of a base oil refers to an amount of the base oil more than 50 wt. %, more than 60 wt. %, more than 70 wt. %, more than 80 wt. %, or more than 90 wt. % of the lubricating oil composition.

In the following description, all numbers disclosed herein are approximate values, regardless whether the word "about" or "approximate" is used in connection therewith. They may vary by 1 percent, 2 percent, 5 percent, or, sometimes, 10 to 20 percent.

The term "Total Base Number" or "TBN" refers to the level of alkalinity in an oil sample, which indicates the ability of the composition to continue to neutralize corrosive acids, in accordance with ASTM Standard No. D2896 or equivalent procedure. The test measures the change in electrical conductivity, and the results are expressed as mgKOH/g (the equivalent number of milligrams of KOH needed to neutralize 1 gram of a product). Therefore, a high TBN reflects strongly overbased products and, as a result, a higher base reserve for neutralizing acids.

The term "construction machines" refers to off-road heavy duty vehicles and off-road vehicles and/or machinery including but not limited to excavators, dozers, loaders, chip spreaders, pavers, compactors, cranes.

The term "PIB" refers to polyisobutylene.

The term "PIBSA" refers to polyisobutylene succinic anhydride.

The term "HPA" refers to heavy polyamine.

The term "DETA" refers to Diethylenetriamine.

The term "TEPA" refers to Triethylenepentamine.

DETAILED DESCRIPTION OF THE INVENTION

In accordance with one embodiment of the present invention, there is provided a Zinc-free transmission oil composition for construction machinery comprising:

(a) a major amount of an oil of lubricating viscosity, (b) at least 0.25 wt. % of a dithiophosphorylated carboxylic acid compound, and (c) a succinimide dispersant derived from a polyisobutylene group of 1200 molecular weight or less.

Also provided is a method for lubricating the transmission of a construction machine comprising lubricating the transmission with a Zinc-free transmission oil composition comprising:

(a) a major amount of an oil of lubricating viscosity, (b) at least 0.25 wt. % of a dithiophosphorylated carboxylic acid compound, and a succinimide dispersant derived from a polyisobutylene group of 1200 molecular weight or less.

Dispersant

In one embodiment, the lubricating oil composition disclosed herein comprises a succinimide dispersant that is derived from a polyisobutylene group with molecular weight of 1200 or less that can prevent sludge, varnish, and other deposits by keeping particles suspended in a colloidal state. Any succinimide dispersant known by a person of ordinary skill in the art may be used in the lubricating oil composition, provided that said succinimide dispersant is derived from a polyisobutylene group with molecular weight of 1200 or less.

In one embodiment, the succinimide dispersant is derived from a polyisobutylene group having a molecular weight of from about 400 to 1200. In another embodiment, the polyisobutylene group has a molecular weight of from about 450 to 1200. In another embodiment, the polyisobutylene group has a molecular weight of from about 450 to 1100. In another embodiment, the polyisobutylene group has a molecular weight of from about 500 to 1100. In another embodiment, the polyisobutylene group has a molecular weight of from about 550 to 1100. In another embodiment, the polyisobutylene group has a molecular weight of from about 600 to 1100. In another embodiment, the polyisobutylene group has a molecular weight of from about 650 to 1100. In another embodiment, the polyisobutylene group has a molecular weight of from about 700 to 1100. In another embodiment, the polyisobutylene group has a molecular weight of from about 750 to 1000. In another embodiment, the polyisobutylene group has a molecular weight of from about 800 to 1000. In another embodiment, the polyisobutylene group has a molecular weight of from about 850 to 1000. In another embodiment, the polyisobutylene group has a molecular weight of from about 900 to 1000. In another embodiment, the polyisobutylene group has a molecular weight of from about 950 to 1000.

Nitrogen-containing basic ashless (metal-free) dispersants contribute to the base number or TBN (as can be measured by ASTM D 2896) of a lubricating oil composition to which they are added, neutralizing acidic and oxidation byproducts without introducing additional sulfated ash.

Succinimide dispersant is a type of nitrogen-containing dispersants. Mono and bis alkenyl succinimides are usually derived from the reaction of alkenyl succinic acid or anhydride and alkylene polyamines. These compounds are generally considered to have the formula (I):

Formula I

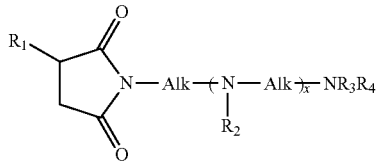

wherein $R_1$ is a substantially hydrocarbon radical having a molecular weight from about 450 to 3000, that is, $R_1$ is a hydrocarbyl radical, preferably an alkenyl radical, containing about 30 to about 200 carbon atoms; Alk is an alkylene radical of 2 to 10, preferably 2 to 6, carbon atoms, $R_2$, $R_3$, and $R_4$ are selected from a $C_1$-$C_4$ alkyl or alkoxy or hydrogen, preferably hydrogen, and x is an integer from 0 to 10, preferably 0 to 3;

or formula (II):

Formula II

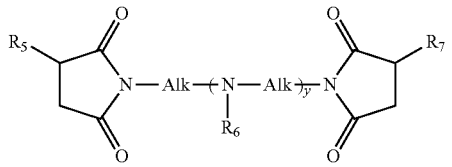

wherein $R_5$ and $R_7$ are both substantially hydrocarbon radical having a molecular weight from about 450 to 3000, that is, $R_5$ and $R_7$ are hydrocarbyl radical, preferably an alkenyl radical, containing about 30 to about 200 carbon atoms; Alk is an alkylene radical of 2 to 10, preferably 2 to 6, carbon atoms, $R_6$ is selected from a $C_1$-$C_4$ alkyl or alkoxy or hydrogen, preferably hydrogen, and y is an integer from 0 to 10, preferably 0 to 3. In one embodiment, $R_1$, $R_5$ and $R_7$ are polyisobutyl groups.

In one embodiment, the actual reaction product of alkylene or alkenylene succinic acid or anhydride and alkylene polyamine will comprise the mixture of compounds including monosuccinimides and bissuccinimides. The mono alkenyl succinimide and bis alkenyl succinimide produced may depend on the charge mole ratio of polyamine to succinic groups and the particular polyamine used. Charge mole ratios of polyamine to succinic groups of about 1:1 may produce predominantly mono alkenyl succinimide. Charge mole ratios of polyamine to succinic group of about 1:2 may produce predominantly bis alkenyl succinimide. Examples of succinimide dispersants include those described in, for example, U.S. Pat. Nos. 3,172,892, 4,234,435 and 6,165,235, which are herein fully incorporated by reference.

In one embodiment, the polyalkenes from which the substituent groups are derived are typically homopolymers and interpolymers of polymerizable olefin monomers of 2 to about 16 carbon atoms, and usually 2 to 6 carbon atoms. The amines which are reacted with the succinic acylating agents to form the carboxylic dispersant composition can be monoamines or polyamines.

In a preferred aspect, the alkenyl succinimide may be prepared by reacting a polyalkylene succinic anhydride with an alkylene polyamine. The polyalkylene succinic anhydride is the reaction product of a polyalkylene (preferably polyisobutene) with maleic anhydride. One can use conventional polyisobutene, or high methylvinylidene polyisobutene in the preparation of such polyalkylene succinic anhydrides. One can use thermal, chlorination, free radical, acid catalyzed, or any other process in this preparation. Examples of suitable polyalkylene succinic anhydrides are thermal PIBSA (polyisobutenyl succinic anhydride) described in U.S. Pat. No. 3,361,673; chlorination PIBSA described in U.S. Pat. No. 3,172,892; a mixture of thermal and chlorination PIBSA described in U.S. Pat. No. 3,912,764; high succinic ratio PIBSA described in U.S. Pat. No. 4,234,435; PolyPIBSA described in U.S. Pat. Nos. 5,112,507 and 5,175,225; high succinic ratio PolyPIBSA described in U.S. Pat. Nos. 5,565,528 and 5,616,668; free radical PIBSA described in U.S. Pat. Nos. 5,286,799, 5,319,030, and 5,625,004; PIBSA made from high methylvinylidene polybutene described in U.S. Pat. Nos. 4,152,499, 5,137,978, and 5,137,980; high succinic ratio PIBSA made from high methylvinylidene polybutene described in European Patent Application Publication No. EP 355 895; terpolymer PIBSA described in U.S. Pat. No. 5,792,729; sulfonic acid PIBSA described in U.S. Pat. No. 5,777,025 and European Patent Application Publication No. EP 542 380; and purified PIBSA described in U.S. Pat. No. 5,523,417 and European Patent Application Publication No. EP 602 863. The disclosures of each of these documents are incorporated herein by reference in their entirety. The polyalkylene succinic anhydride is preferably a polyisobutenyl succinic anhydride. In one preferred embodiment, the polyalkylene succinic anhydride is a polyisobutenyl succinic anhydride that is derived from a polyisobutylene having a number average molecular weight of 1200 or less, preferably from 400 to 1200, preferably from 500 to 1100, from 550 to 1100, from 600 to 1100, from 650 to 1100, from 700 to 1100, from 750 to 1100, from 800 to 1000, from 850 to 1000, from 900 to 1000, and from 950 to 1000.

The preferred polyalkylene amines used to prepare the succinimides are of the formula (III):

Formula III

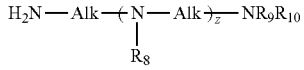

wherein z is an integer of from 0 to 10 and Alk is an alkylene radical of 2 to 10, preferably 2 to 6, carbon atoms, $R_8$, $R_9$, and $R_{10}$ are as are selected from a $C_1$-$C_4$ alkyl or alkoxy or hydrogen, preferably hydrogen, and z is an integer from 0 to 10, preferably 0 to 3.

The alkylene amines include principally methylene amines, ethylene amines, butylene amines, propylene amines, pentylene amines, hexylene amines, heptylene amines, octylene amines, other polymethylene amines and also the cyclic and the higher homologs of such amines as piperazine and amino alkyl-substituted piperazines. They are exemplified specifically by ethylene diamine, triethylene tetraamine, propylene diamine, decamethyl diamine, octamethylene diamine, diheptamethylene triamine, tripropylene tetraamine, tetraethylene pentamine, trimethylene diamine, pentaethylene hexamine, ditrimethylene triamine, 2-heptyl-3-(2-aminopropyl)-imidazoline, 4-methyl imidazoline, N,N-dimethyl-1,3-propane diamine, 1,3-bis(2-aminoethyl)imidazoline, 1-(2-aminopropyl)-piperazine, 1,4-bis(2-aminoethyl)piperazine and 2-methyl-1-(2-aminobutyl) piperazine. Higher homologs such as are obtained by condensing two or more of the above-illustrated alkylene amines likewise are useful.

The ethylene amines are especially useful. They are described in some detail under the heading "Ethylene Amines" in Encyclopedia of Chemical Technology, Kirk-Othmer, Vol. 5, pp. 898-905 (Interscience Publishers, New York, 1950). The term "ethylene amine" is used in a generic sense to denote a class of polyamines conforming for the most part to the formula (IV):

$$H_2N(CH_2CH_2NH)_aH \qquad \text{Formula IV}$$

wherein a is an integer from 1 to 10. Thus, it includes, for example, ethylene diamine, diethylene triamine, triethylene tetraamine, tetraethylene pentamine, pentaethylene hexamine, and the like.

The individual alkenyl succinimides used in the alkenyl succinimide composition of the present invention can be prepared by conventional processes, such as disclosed in U.S. Pat. Nos. 2,992,708; 3,018,250; 3,018,291; 3,024,237; 3,100,673; 3,172,892; 3,202,678; 3,219,666; 3,272,746; 3,361,673; 3,381,022; 3,912,764; 4,234,435; 4,612,132; 4,747,965; 5,112,507; 5,241,003; 5,266,186; 5,286,799; 5,319,030; 5,334,321; 5,356,552; 5,716,912, the disclosures of which are all hereby incorporated by reference in their entirety for all purposes.

Also included within the term "alkenyl succinimides" are post-treated succinimides such as post-treatment processes involving borate or ethylene carbonate disclosed by Wollenberg, et al., U.S. Pat. No. 4,612,132; Wollenberg, et al., U.S. Pat. No. 4,746,446; and the like as well as other post-treatment processes each of which are incorporated herein by reference in its entirety. Preferably, the carbonate-treated alkenyl succinimide is a polybutene succinimide derived from polybutenes having a molecular weight of 450 to 3000, preferably from 900 to 2500, more preferably from 1300 to 2300, and preferably from 2000 to 2400, as well as mixtures of these molecular weights. Preferably, it is prepared by reacting, under reactive conditions, a mixture of a polybutene succinic acid derivative, an unsaturated acidic reagent copolymer of an unsaturated acidic reagent and an olefin, and a polyamine, such as taught in U.S. Pat. No. 5,716,912 incorporated herein by reference.

In one embodiment, the dispersant system comprises from 1 to 20 wt. %, preferably 1-15 wt. %, preferably 2-12 wt. %, preferably 2-8 wt. %, preferably 2-6 wt. %, preferably 2-5 wt. %, preferably 3-8, and preferably 3-5 wt. %, of the weight of the lubricating oil composition.

Dithiophosphorylated Carboxylic Acid

In one embodiment, the lubricating oil composition disclosed herein comprise a dithiophosphorylated carboxylic acid compound represented by the formula V:

Formula (V)

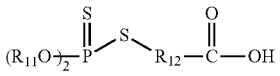

In formula (V), $R_{11}$ is hydrocarbyl selected from straight and branched chain alkyl, cycloalkyl and alkylphenyl. Preferred substituents for $R_{11}$ are independently selected from alkyl from 3 to 10 carbon atoms, such as propyl, isopropyl, butyl, isobutyl, tert-butyl, pentyl, isopentyl, hexyl, 2-ethylbutyl, 1-methylpentyl, 1,3 dimethylbutyl, 2 ethylhexyl, and the like, cycloalkyl from 5 to 7 carbon atoms, such as cyclopentyl, cyclohexyl, cycloheptyl, and alkylphenyl with alkyl groups from 1-30 carbon atoms. Particularly preferred groups for $R_{11}$ are mixtures of the foregoing. In another embodiment, preferred alkyl groups for $R_{11}$ are selected from isopropyl, isobutyl and 2-ethylhexyl. $R_{12}$ is selected from the group consisting of alkylene of 1-10 carbon atoms, such as ethylene, n-propylene, isopropylene, n-butylene, isobutylene and sec-butylene. More preferred is isopropylene.

In another embodiment, the dithiophosphorylated carboxylic acid is a 3-dithiophosphoryl-2-methylpropionic acid, such as 3-[[bis(2-methylpropoxy)phosphinothioyl]thio]-2-methylpropanoic acid having the structure in Formula VI below:

Formula (VI)

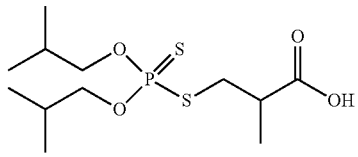

The compound of Formula VI is commercially available and marketed under the trademark IRGALUBE® 353.

The concentration of the dithiophosphorylated carboxylic acid in the lubricating oil composition disclosed herein is at least about 0.25 wt. %. In one embodiment, the amount of the dithiophosphorylated carboxylic acid in the lubricating oil compositions disclosed herein is about 0.25 to 2 wt. % based on the total weight of the lubricating oil composition. In one embodiment, the amount of the dithiophosphorylated carboxylic acid in the lubricating oil compositions is 0.25 to 1.75 wt. %. In one embodiment, the amount of the dithiophosphorylated carboxylic acid in the lubricating oil compositions is 0.25 to 1.5 wt. %. In one embodiment, the amount of the dithiophosphorylated carboxylic acid in the lubricating oil compositions is 0.25 to 1.25 wt. %. In one embodiment, the amount of the dithiophosphorylated carboxylic acid in the lubricating oil compositions is 0.25 to 1 wt. %. In one embodiment, the amount of the dithiophosphorylated carboxylic acid in the lubricating oil compositions is 0.25 to 0.75 wt. %. In one embodiment, the amount of the dithiophosphorylated carboxylic acid in the lubricating oil compositions is 0.25 to 0.5 wt. %.

The Oil of Lubricating Viscosity

The lubricating oil compositions disclosed herein generally comprise at least one oil of lubricating viscosity. Any base oil known to a skilled artisan can be used as the oil of lubricating viscosity disclosed herein. Some base oils suitable for preparing the lubricating oil compositions have been described in Mortier et al., "*Chemistry and Technology of Lubricants,*" 2nd Edition, London, Springer, Chapters 1 and 2 (1996); and A. Sequeria, Jr., "*Lubricant Base Oil and Wax Processing*," New York, Marcel Decker, Chapter 6, (1994); and D. V. Brock, *Lubrication Engineering*, Vol. 43, pages 184-5, (1987), all of which are incorporated herein by reference. Generally, the amount of the base oil in the lubricating oil composition may be from about 70 to about 99.5 wt. %, based on the total weight of the lubricating oil composition. In some embodiments, the amount of the base oil in the lubricating oil composition is from about 75 to about 99 wt. %, from about 80 to about 98.5 wt. %, or from about 80 to about 98 wt. %, based on the total weight of the lubricating oil composition.

In certain embodiments, the base oil is or comprises any natural or synthetic lubricating base oil fraction. Some non-limiting examples of synthetic oils include oils, such as polyalphaolefins or PAOs, prepared from the polymerization of at least one alpha-olefin, such as ethylene, or from hydrocarbon synthesis procedures using carbon monoxide and hydrogen gases, such as the Fisher-Tropsch process. In certain embodiments, the base oil comprises less than about 10 wt. % of one or more heavy fractions, based on the total weight of the base oil. A heavy fraction refers to a lube oil fraction having a viscosity of at least about 20 cSt at 100° C. In certain embodiments, the heavy fraction has a viscosity of at least about 25 cSt or at least about 30 cSt at 100° C. In further embodiments, the amount of the one or more heavy fractions in the base oil is less than about 10 wt. %, less than about 5 wt. %, less than about 2.5 wt. %, less than about 1 wt. %, or less than about 0.1 wt. %, based on the total weight of the base oil. In still further embodiments, the base oil comprises no heavy fraction.

In certain embodiments, the lubricating oil compositions comprise a major amount of a base oil of lubricating viscosity. In some embodiments, the base oil has a kinematic viscosity at 100° C. from about 2.5 centistokes (cSt) to about 20 cSt, from about 4 centistokes (cSt) to about 20 cSt, or from about 5 cSt to about 16 cSt. The kinematic viscosity of the base oils or the lubricating oil compositions disclosed herein can be measured according to ASTM D 445, which is incorporated herein by reference.

In other embodiments, the base oil is or comprises a base stock or blend of base stocks. In further embodiments, the base stocks are manufactured using a variety of different processes including, but not limited to, distillation, solvent refining, hydrogen processing, oligomerization, esterification, and rerefining. In some embodiments, the base stocks comprise a rerefined stock. In further embodiments, the rerefined stock shall be substantially free from materials introduced through manufacturing, contamination, or previous use.

In some embodiments, the base oil comprises one or more of the base stocks in one or more of Groups I-V as specified in the American Petroleum Institute (API) Publication 1509, Fourteen Edition, December 1996 (i.e., API Base Oil Interchangeability Guidelines for Passenger Car Motor Oils and Diesel Engine Oils), which is incorporated herein by reference. The API guideline defines a base stock as a lubricant component that may be manufactured using a variety of different processes. Groups I, II and III base stocks are mineral oils, each with specific ranges of the amount of saturates, sulfur content and viscosity index. Group IV base stocks are polyalphaolefins (PAO). Group V base stocks include all other base stocks not included in Group I, II, III, or IV.

In some embodiments, the base oil comprises one or more of the base stocks in Group I, II, III, IV, V or a combination thereof. In other embodiments, the base oil comprises one or more of the base stocks in Group II, III, IV or a combination thereof. In further embodiments, the base oil comprises one or more of the base stocks in Group II, III, IV or a combination thereof wherein the base oil has a kinematic viscosity from about 2.5 centistokes (cSt) to about 20 cSt, from about 4 cSt to about 20 cSt, or from about 5 cSt to about 16 cSt at 100° C.

The base oil may be selected from the group consisting of natural oils of lubricating viscosity, synthetic oils of lubricating viscosity and mixtures thereof. In some embodiments, the base oil includes base stocks obtained by isomerization of synthetic wax and slack wax, as well as hydrocrackate base stocks produced by hydrocracking (rather than solvent extracting) the aromatic and polar components of the crude. In other embodiments, the base oil of lubricating viscosity includes natural oils, such as animal oils, vegetable oils, mineral oils (e.g., liquid petroleum oils and solvent treated or acid-treated mineral oils of the paraffinic, naphthenic or mixed paraffinic-naphthenic types), oils derived from coal or shale, and combinations thereof. Some non-limiting examples of animal oils include bone oil, lanolin, fish oil, lard oil, dolphin oil, seal oil, shark oil, tallow oil, and whale oil. Some non-limiting examples of vegetable oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, and meadow foam oil. Such oils may be partially or fully hydrogenated.

In some embodiments, the synthetic oils of lubricating viscosity include hydrocarbon oils and halo-substituted hydrocarbon oils such as polymerized and inter-polymerized olefins, alkylbenzenes, polyphenyls, alkylated diphenyl ethers, alkylated diphenyl sulfides, as well as their derivatives, analogues and homologues thereof, and the like. In other embodiments, the synthetic oils include alkylene oxide polymers, interpolymers, copolymers and derivatives thereof wherein the terminal hydroxyl groups can be modified by esterification, etherification, and the like. In further embodiments, the synthetic oils include the esters of dicarboxylic acids with a variety of alcohols. In certain embodiments, the synthetic oils include esters made from $C_5$ to $C_{12}$ monocarboxylic acids and polyols and polyol ethers. In further embodiments, the synthetic oils include tri-alkyl phosphate ester oils, such as tri-n-butyl phosphate and tri-iso-butyl phosphate.

In some embodiments, the synthetic oils of lubricating viscosity include silicon-based oils (such as the polyakyl-, polyaryl-, polyalkoxy-, polyaryloxy-siloxane oils and silicate oils). In other embodiments, the synthetic oils include liquid esters of phosphorus-containing acids, polymeric tetrahydrofurans, polyalphaolefins, and the like.

Base oil derived from the hydroisomerization of wax may also be used, either alone or in combination with the aforesaid natural and/or synthetic base oil. Such wax isomerate oil is produced by the hydroisomerization of natural or synthetic waxes or mixtures thereof over a hydroisomerization catalyst.

In further embodiments, the base oil comprises a poly-alpha-olefin (PAO). In general, the poly-alpha-olefins may be derived from an alpha-olefin having from about 2 to about 30, from about 4 to about 20, or from about 6 to about 16 carbon atoms. Non-limiting examples of suitable poly-alpha-olefins include those derived from octene, decene, mixtures thereof, and the like. These poly-alpha-olefins may have a viscosity from about 2 to about 15, from about 3 to about 12, or from about 4 to about 8 centistokes at 100° C. In some instances, the poly-alpha-olefins may be used together with other base oils such as mineral oils.

In further embodiments, the base oil comprises a polyalkylene glycol or a polyalkylene glycol derivative, where the terminal hydroxyl groups of the polyalkylene glycol may be modified by esterification, etherification, acetylation and the like. Non-limiting examples of suitable polyalkylene glycols include polyethylene glycol, polypropylene glycol, polyisopropylene glycol, and combinations thereof. Non-limiting examples of suitable polyalkylene glycol derivatives include ethers of polyalkylene glycols (e.g., methyl ether of polyisopropylene glycol, diphenyl ether of polyethylene glycol, diethyl ether of polypropylene glycol, etc.), mono- and polycarboxylic esters of polyalkylene glycols, and combinations thereof. In some instances, the polyalkylene glycol or polyalkylene glycol derivative may be used together with other base oils such as poly-alpha-olefins and mineral oils.

In further embodiments, the base oil comprises any of the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, and the like) with a variety of alcohols (e.g., butyl alcohol, hexyl alcohol, dodecyl alcohol, 2-ethylhexyl alcohol, ethylene glycol, diethylene glycol monoether, propylene glycol, and the like). Non-limiting examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the like.

In further embodiments, the base oil comprises a hydrocarbon prepared by the Fischer-Tropsch process. The Fischer-Tropsch process prepares hydrocarbons from gases containing hydrogen and carbon monoxide using a Fischer-Tropsch catalyst. These hydrocarbons may require further processing in order to be useful as base oils. For example, the hydrocarbons may be dewaxed, hydroisomerized, and/or hydrocracked using processes known to a person of ordinary skill in the art.

In further embodiments, the base oil comprises an unrefined oil, a refined oil, a rerefined oil, or a mixture thereof. Unrefined oils are those obtained directly from a natural or synthetic source without further purification treatment. Non-limiting examples of unrefined oils include shale oils obtained directly from retorting operations, petroleum oils obtained directly from primary distillation, and ester oils obtained directly from an esterification process and used without further treatment. Refined oils are similar to the unrefined oils except the former have been further treated by one or more purification processes to improve one or more properties. Many such purification processes are known to those skilled in the art such as solvent extraction, secondary distillation, acid or base extraction, filtration, percolation, and the like. Rerefined oils are obtained by applying to refined oils processes similar to those used to obtain refined oils. Such rerefined oils are also known as reclaimed or reprocessed oils and often are additionally treated by processes directed to removal of spent additives and oil breakdown products.

Other Additives

Optionally, the lubricating oil composition may further comprise at least an additive or a modifier (hereinafter designated as "additive") that can impart or improve any desirable property of the lubricating oil composition. Any additive known to a person of ordinary skill in the art may be used in the lubricating oil compositions disclosed herein. Some suitable additives have been described in Mortier et al., "*Chemistry and Technology of Lubricants,*" 2nd Edition. London, Springer, (1996); and Leslie R. Rudnick, "*Lubricant Additives: Chemistry and Applications*," New York, Marcel Dekker (2003), both of which are incorporated herein by reference. In some embodiments, the additive can be selected from the group consisting of antioxidants, anti-wear agents, detergents, rust inhibitors, demulsifiers, friction modifiers, multi-functional additives, viscosity index improvers, pour point depressants, foam inhibitors, metal deactivators, dispersants, corrosion inhibitors, lubricity improvers, thermal stability improvers, anti-haze additives, icing inhibitors, dyes, markers, static dissipaters, biocides and combinations thereof. In general, the concentration of each of the additives in the lubricating oil composition, when used, may range from about 0.001 wt. % to about 10 wt. %, from about 0.01 wt. % to about 5 wt. %, or from about 0.1 wt. % to about 2.5 wt. %, based on the total weight of the lubricating oil composition. Further, the total amount of the additives in the lubricating oil composition may range from about 0.001 wt. % to about 20 wt. %, from about 0.01 wt. % to about 10 wt. %, or from about 0.1 wt. % to about 5 wt. %, based on the total weight of the lubricating oil composition.

Optionally, the lubricating oil composition disclosed herein can further comprise an additional antioxidant that can reduce or prevent the oxidation of the base oil. Any antioxidant known by a person of ordinary skill in the art may be used in the lubricating oil composition. Non-limiting examples of suitable antioxidants include amine-based antioxidants (e.g., alkyl diphenylamines, phenyl-α-naphthylamine, alkyl or aralkyl substituted phenyl-α-naphthylamine, alkylated p-phenylene diamines, tetramethyl-diaminodiphenylamine and the like), phenolic antioxidants (e.g., 2-tert-butylphenol, 4-methyl-2,6-di-tert-butylphenol, 2,4,6-tri-tert-butylphenol, 2,6-di-tert-butyl-p-cresol, 2,6-di-tert-butylphenol, 4,4'-methylenebis-(2,6-di-tert-butylphenol), 4,4'-thiobis(6-di-tert-butyl-o-cresol) and the like), sulfur-based antioxidants (e.g., dilauryl-3,3'-thiodipropionate, sulfurized phenolic antioxidants and the like), phosphorous-based antioxidants (e.g., phosphites and the like), zinc dithiophosphate, oil-soluble copper compounds and combinations thereof. The amount of the antioxidant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable antioxidants have been described in Leslie R. Rudnick, "Lubricant Additives: Chemistry and Applications," New York. Marcel Dekker, Chapter 1, pages 1-28 (2003), which is incorporated herein by reference.

Some non-limiting examples of suitable metal detergent include sulfurized or unsulfurized alkyl or alkenyl phenates, alkyl or alkenyl aromatic sulfonates, borated sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof. Other non-limiting examples of suitable metal detergents include metal sulfonates, phenates, salicylates, phosphonates, thiophosphonates and combinations thereof. The metal can be any metal suitable for making sulfonate, phenate, salicylate or phosphonate detergents. Non-limiting examples of suitable metals include alkali metals, alkaline metals and transition metals. In some embodiments, the metal is Ca, Mg, Ba, K, Na, Li or the like.

Generally, the amount of the detergent is from about 0.001 wt. % to about 5 wt. %, from about 0.05 wt. % to about 3 wt. %, or from about 0.1 wt. % to about 1 wt. %, based on the total weight of the lubricating oil composition. Some suitable detergents have been described in Mortier et al., "*Chemistry and Technology of Lubricants,*" 2nd Edition, London, Springer, Chapter 3, pages 75-85 (1996); and Leslie R. Rudnick, "*Lubricant Additives: Chemistry and Applications*," New York, Marcel Dekker, Chapter 4, pages 113-136 (2003), both of which are incorporated herein by reference.

The lubricating oil composition disclosed herein can optionally comprise a friction modifier that can lower the friction between moving parts. Any friction modifier known by a person of ordinary skill in the art may be used in the lubricating oil composition. Non-limiting examples of suitable friction modifiers include fatty carboxylic acids: derivatives (e.g., alcohol, esters, borated esters, amides, metal salts and the like) of fatty carboxylic acid; mono-, di- or tri-alkyl substituted phosphoric acids or phosphonic acids; derivatives (e.g., esters, amides, metal salts and the like) of mono-, di- or tri-alkyl substituted phosphoric acids or phosphonic acids; mono-, di- or tri-alkyl substituted amines; mono- or di-alkyl substituted amides and combinations thereof. In some embodiments, the friction modifier is selected from the group consisting of aliphatic amines, ethoxylated aliphatic amines, aliphatic carboxylic acid amides, ethoxylated aliphatic ether amines, aliphatic carboxylic acids, glycerol esters, aliphatic carboxylic ester-amides, fatty imidazolines, fatty tertiary amines, wherein the aliphatic or fatty group contains more than about eight carbon atoms so as to render the compound suitably oil soluble. In other embodiments, the friction modifier comprises an aliphatic substituted succinimide formed by reacting an aliphatic succinic acid or anhydride with ammonia or a primary amine. The amount of the friction modifier may vary from about 0.01 wt. % to about 10 wt. %, from about 0.05 wt. % to about 5 wt. %, or from about 0.1 wt. % to about 3 wt. %, based on the total weight of the lubricating oil composition. Some suitable friction modifiers have been described in Mortier et al., "*Chemistry and Technology of Lubricants,*" 2nd Edition, London, Springer, Chapter 6, pages 183-187 (1996); and Leslie R. Rudnick, "*Lubricant Additives: Chemistry and Applications*," New York, Marcel Dekker, Chapters 6 and 7, pages 171-222 (2003), both of which are incorporated herein by reference.

The lubricating oil composition disclosed herein can optionally comprise a pour point depressant that can lower the pour point of the lubricating oil composition. Any pour point depressant known by a person of ordinary skill in the art may be used in the lubricating oil composition. Non-limiting examples of suitable pour point depressants include polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In some embodiments, the pour point depressant comprises an ethylene-vinyl acetate copolymer, a condensate of chlorinated paraffin and phenol, polyalkyl styrene or the like. The amount of the pour point depressant may vary from about 0.01 wt. % to about 10 wt. %, from about 0.05 wt. % to about 5 wt. %, or from about 0.1 wt. % to about 3 wt. %, based on the total weight of the lubricating oil composition. Some suitable pour point depressants have been described in Mortier et al., "*Chemistry and Technology of Lubricants,*" 2nd Edition, London, Springer, Chapter 6, pages 187-189 (1996); and Leslie R. Rudnick, "*Lubricant Additives: Chemistry and Applications*," New York, Marcel Dekker, Chapter 11, pages 329-354 (2003), both of which are incorporated herein by reference.

The lubricating oil composition disclosed herein can optionally comprise a demulsifier that can promote oil-water separation in lubricating oil compositions that are exposed to water or steam. Any demulsifier known by a person of ordinary skill in the art may be used in the lubricating oil composition. Non-limiting examples of suitable demulsifiers include anionic surfactants (e.g., alkyl-naphthalene sulfonates, alkyl benzene sulfonates and the like), nonionic alkoxylated alkylphenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and combinations thereof. The amount of the demulsifier may vary from about 0.01 wt. % to about 10 wt. %, from about 0.05 wt. % to about 5 wt. %, or from about 0.1 wt. % to about 3 wt. %, based on the total weight of the lubricating oil composition. Some suitable demulsifiers have been described in Mortier et al., "*Chemistry and Technology of Lubricants,*" 2nd Edition. London, Springer, Chapter 6, pages 190-193 (1996), which is incorporated herein by reference.

The lubricating oil composition disclosed herein can optionally comprise a foam inhibitor or an anti-foam that can break up foams in oils. Any foam inhibitor or anti-foam known by a person of ordinary skill in the art may be used in the lubricating oil composition. Non-limiting examples of suitable anti-foams include silicone oils or polydimethylsiloxanes, fluorosilicones, alkoxylated aliphatic acids, polyethers (e.g., polyethylene glycols), branched polyvinyl ethers, alkyl acrylate polymers, alkyl methacrylate polymers, polyalkoxyamines and combinations thereof. In some embodiments, the anti-foam comprises glycerol monostearate, polyglycol palmitate, a trialkyl monothiophosphate, an ester of sulfonated ricinoleic acid, benzoylacetone, methyl salicylate, glycerol monooleate, or glycerol dioleate. The amount of the anti-foam may vary from about 0.01 wt. % to about 5 wt. %, from about 0.05 wt. % to about 3 wt. %, or from about 0.1 wt. % to about 1 wt. %, based on the total weight of the lubricating oil composition. Some suitable anti-foams have been described in Mortier et al., "*Chemistry and Technology of Lubricants,*" 2nd Edition, London, Springer, Chapter 6, pages 190-193 (1996), which is incorporated herein by reference.

The lubricating oil composition disclosed herein can optionally comprise a corrosion inhibitor that can reduce corrosion. Any corrosion inhibitor known by a person of ordinary skill in the art may be used in the lubricating oil composition. Non-limiting examples of suitable corrosion inhibitor include half esters or amides of dodecylsuccinic acid, phosphate esters, thiophosphates, alkyl imidazolines, sarcosines and combinations thereof. The amount of the corrosion inhibitor may vary from about 0.01 wt. % to about 5 wt. %, from about 0.05 wt. % to about 3 wt. %, or from about 0.1 wt. % to about 1 wt. %, based on the total weight of the lubricating oil composition. Some suitable corrosion inhibitors have been described in Mortier et al., "*Chemistry and Technology of Lubricants,*" 2nd Edition, London, Springer, Chapter 6, pages 193-196 (1996), which is incorporated herein by reference.

The lubricating oil composition disclosed herein can optionally comprise an extreme pressure (EP) agent that can prevent sliding metal surfaces from seizing under conditions of extreme pressure. Any extreme pressure agent known by a person of ordinary skill in the art may be used in the lubricating oil composition. Generally, the extreme pressure agent is a compound that can combine chemically with a metal to form a surface film that prevents the welding of asperities in opposing metal surfaces under high loads. Non-limiting examples of suitable extreme pressure agents include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and combinations thereof. The amount of the extreme pressure agent may vary from about 0.01 wt. % to about 5 wt. %, from about 0.05 wt. % to about 3 wt. %, or from about 0.1 wt. % to about 1 wt. %, based on the total weight of the lubricating oil composition. Some suitable extreme pressure agents have been described in Leslie R. Rudnick, "*Lubricant Additives: Chemistry and Applications*," New York, Marcel Dekker, Chapter 8, pages 223-258 (2003), which is incorporated herein by reference.

The lubricating oil composition disclosed herein can optionally comprise a rust inhibitor that can inhibit the corrosion of ferrous metal surfaces. Any rust inhibitor known by a person of ordinary skill in the art may be used in the lubricating oil composition. Non-limiting examples of suitable rust inhibitors include oil-soluble monocarboxylic acids (e.g., 2-ethylhexanoic acid, lauric acid, myristic acid, palmitic acid, oleic acid, linoleic acid, linolenic acid, behenic acid, cerotic acid and the like), oil-soluble polycarboxylic acids (e.g., those produced from tall oil fatty acids, oleic acid, linoleic acid and the like), alkenylsuccinic acids in which the alkenyl group contains 10 or more carbon atoms (e.g., tetrapropenylsuccinic acid, tetradecenylsuccinic acid, hexadecenylsuccinic acid, and the like); long-chain alpha,omega-dicarboxylic acids having a molecular weight in the range of 600 to 3000 daltons and combinations thereof. The amount of the rust inhibitor may vary from about 0.01 wt. % to about 10 wt. %, from about 0.05 wt. % to about 5 wt. %, or from about 0.1 wt. % to about 3 wt. %, based on the total weight of the lubricating oil composition.

Other non-limiting examples of suitable rust inhibitors include nonionic polyoxyethylene surface active agents such as polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate. Further non-limiting examples of suitable rust inhibitor include stearic acid and other fatty acids, dicarboxylic acids, metal soaps, fatty acid amine salts, metal salts of heavy sulfonic acid, partial carboxylic acid ester of polyhydric alcohol, and phosphoric ester.

In some embodiments, the lubricating oil composition comprises at least a multifunctional additive. Some non-limiting examples of suitable multifunctional additives include sulfurized oxymolybdenum dithiocarbamate, sulfurized oxymolybdenum organophosphorodithioate, oxymolybdenum monoglyceride, oxymolybdenum diethylate amide, amine-molybdenum complex compound, and sulfur-containing molybdenum complex compound.

In certain embodiments, the lubricating oil composition comprises at least a viscosity index improver. Some non-limiting examples of suitable viscosity index improvers include polymethacrylate type polymers, ethylene-propylene copolymers, styrene-isoprene copolymers, hydrated styrene-isoprene copolymers, polyisobutylene, and dispersant type viscosity index improvers.

In some embodiments, the lubricating oil composition comprises at least a metal deactivator. Some non-limiting examples of suitable metal deactivators include disalicylidene propylenediamine, triazole derivatives, thiadiazole derivatives, and mercaptobenzimidazoles.

The additives disclosed herein may be in the form of an additive concentrate having more than one additive. The additive concentrate may comprise a suitable diluent, such as a hydrocarbon oil of suitable viscosity. Such diluent can be selected from the group consisting of natural oils (e.g., mineral oils), synthetic oils and combinations thereof. Some non-limiting examples of the mineral oils include paraffin-based oils, naphthenic-based oils, asphaltic-based oils and combinations thereof. Some non-limiting examples of the synthetic base oils include polyolefin oils (especially hydrogenated alpha-olefin oligomers), alkylated aromatic, polyalkylene oxides, aromatic ethers, and carboxylate esters (especially diester oils) and combinations thereof. In some embodiments, the diluent is a light hydrocarbon oil, both natural or synthetic. Generally, the diluent oil can have a viscosity from about 13 centistokes to about 35 centistokes at 40° C.

Generally, it is desired that the diluent readily solubilizes the lubricating oil soluble additive of the invention and provides an oil additive concentrate that is readily soluble in the lubricant base oil stocks or fuels. In addition, it is desired that the diluent not introduce any undesirable characteristics, including, for example, high volatility, high viscosity, and impurities such as heteroatoms, to the lubricant base oil stocks and thus, ultimately to the finished lubricant or fuel.

The present invention further provides an oil soluble additive concentrate composition comprising an inert diluent and from 2.0% to 90% by weight, preferably 10% to 50% by weight based on the total concentrate, of an oil soluble additive composition according to the present invention.

The following examples are presented to exemplify embodiments of the invention but are not intended to limit the invention to the specific embodiments set forth. Unless indicated to the contrary, all parts and percentages are by weight. All numerical values are approximate. When numerical ranges are given, it should be understood that embodiments outside the stated ranges may still fall within the scope of the invention. Specific details described in each example should not be construed as necessary features of the invention.

Examples

The following examples are intended for illustrative purposes only and do not limit in any way the scope of the present invention. Table 1 shows both the Inventive and Comparative examples, together with test results for the Micro-clutch Test and the Shell 4-ball test.

Detergent 1 is an oil concentrate of high overbased 320 TBN Ca alkyltoluene sulfonate.

Detergent 2 is an oil concentrate of 260 TBN sulfurized Ca phenate.

Detergent 3 is an oil concentrate of 17 TBN Ca alkyltoluene sulfonate.

The dithiophosphate carboxylic acid compound is a 3-[[bis(2-methylpropoxy)phosphinothioyl]thio]-2-methyl-propanoic acid (IRGALUBE® 353), available from BASF, (Ludwigshafen, Germany)

Dispersant 1 is an oil concentrate of a succinimide derived from 1000 MW polyisobutylene.

Dispersant 2 is an oil concentrate of a bis-succinimide derived from 1300 MW polyisobutylene.

Dispersant 3 is an oil concentrate of an ethylene carbonate treated bis-succinimide derived from 1000 MW polyisobutylene.

Friction modifier is oleic amide.

Duraphos DBHP is dibutyl hydrogen phosphite, available from Rhodia Chemical Company (La Défense, France)

Micro-Clutch Test

The Inventive and Comparative Examples were evaluated using the Micro-clutch test. Friction Coefficients were measured using a micro-clutch apparatus made by Komatsu Engineering and following the Komatsu KES 07.802 procedure. That is, the disc and the plates as specified in the procedure were contacted with the pressure of 4 kgf/cm2 against the disc rotating at 20 rpm in the presence of additive components dissolved in mineral oil. The friction coefficient was measured at room temperature (25° C.), 60° C., 80° C., 100° C., 120° C., and 140° C. The results for high temperature (140° C.) are shown in Table 1. The criteria for passing the test is a friction coefficient greater than 0.130.

Shell 4-Ball Welding Load Test

The welding point was evaluated by means of the Shell 4-ball test. This test is operated with one steel ball under load rotating against three steel balls held stationary in the form of a cradle. Test examples cover the lower three balls. The rotating speed is 1760±40 rpm. A series of tests of 10 s duration were made at increasing load until welding occurs. The target welding load is 1960 N. The weld point is greatly influenced by the types of phosphorus compounds and those dosage. The results are shown in Table 1.

TABLE 1

| Component | Ex. 1 | Ex. 2 | Ex. 3 | Ex. 4 | Ex. 5 | Ex. 6 |
|---|---|---|---|---|---|---|
| Detergent 1 (wt %) | — | 0.7 | 0.8 | 1.4 | 1.4 | — |
| Detergent 2 (wt %) | 2 | 1.6 | 2 | 1.2 | 1 | 2.0 |
| Detergent 3 (wt %) | — | 0.5 | — | — | 0.5 | — |
| Dithiophosphorylated carboxylic acid (wt %) | 0.3 | 0.4 | 0.4 | 0.4 | 0.4 | 0.4 |
| Amine salt of dithiophosphate | — | — | — | — | — | — |
| Duraphos DBHP (wt %) | — | — | — | — | — | — |
| Dispersant 1 (wt %) | 3.0 | 3.0 | 3.0 | 3.0 | 3.0 | 3.0 |
| Dispersant 2 | — | — | — | — | — | — |
| Dispersant 3 | — | — | — | — | — | — |
| Friction Modifier (wt %) | — | 0.2 | 0.2 | 0.2 | 0.2 | — |
| Polyisobutylene MW | 1000 | 1000 | 1000 | 1000 | 1000 | 1000 |
| P wt % | 0.028 | 0.037 | 0.037 | 0.037 | 0.037 | 0.037 |
| Micro-clutch Test (140° C.) | 0.186 | 0.143 | 0.150 | 0.143 | 0.135 | 0.181 |
| Shell 4-ball WL | 1960 | 1960 | 1960 | 1960 | 1960 | 1960 |

| Component | Ex. 7 | Comp Ex. A | Comp Ex. B | Comp Ex. C | Comp Ex. D | Comp Ex. E |
|---|---|---|---|---|---|---|
| Detergent 1 (wt %) | 1.4 | 1.4 | — | — | — | — |
| Detergent 2 (wt %) | 1.0 | 1.0 | 2.0 | 2.0 | 2.0 | 2.0 |
| Detergent 3 (wt %) | 0.5 | 0.5 | — | — | — | — |
| Dithiophosphorylated carboxylic acid (wt %) | 0.4 | 0.4 | — | — | 0.1 | 0.2 |
| Amine salt of dithiophosphate | — | — | — | 0.4 | 0.3 | — |
| Duraphos DBHP (wt %) | — | — | 0.5 | — | — | — |
| Dispersant 1 (wt %) | — | — | 3.23 | 3.0 | 3.0 | 3.0 |
| Dispersant 2 | | 3.0 | — | — | — | — |
| Dispersant 3 | 3.0 | — | — | — | — | — |
| Friction Modifier (wt %) | 0.2 | 0.2 | — | — | — | — |
| Polyisobutylene MW | 1000 | 1300 | 1000 | 1000 | 1000 | 1000 |
| P wt % | 0.037 | 0.037 | 0.079 | 0.024 | 0.028 | 0.019 |
| Micro-clutch Test (140° C.) | 0.152 | 0.124 | 0.173 | 0.165 | 0.161 | 0.186 |
| Shell 4-ball WL | 1960 | 1568 | 1568 | 1568 | 1568 | 1568 |

As can be seen in Table 1, inventive examples 1-7 show superior performance in both the Micro-clutch test, meaning superior friction performance over the comparative examples and in the Shell 4-ball WL test, meaning superior wear performance over the comparative examples. Comparative examples A contains a succinimide having a polyisobutylene group of greater than 1200 MW. Comparative B-C do not have the dithiophosphorylated compound or the dispersant of the present invention. Comparative examples D and E do not have enough of the dithiophosphorylated carboxylic acid compounds of the present invention.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A Zinc-free transmission oil composition for construction machinery comprising:

(a) a major amount of an oil of lubricating viscosity, (b) at least 0.25 wt. % of a dithiophosphorylated carboxylic acid compound, wherein the dithiophosphorylated carboxylic acid is 3-[[bis(2-methylpropoxy)phosphinothioyl]thio]-2-methyl-propanoic acid, and (c) a succinimide dispersant derived from a polyisobutylene group of 1200 molecular weight or less.

2. The transmission oil composition of claim 1 wherein the dithiophosphorylated carboxylic acid compound is present at 0.25 to 2 wt. %.

3. The transmission oil composition of claim 1 wherein the dithiophosphorylated carboxylic acid compound is present at 0.25 to 1 wt. %.

4. The transmission oil composition of claim 1 wherein the succinimide dispersant is derived from a polyisobutylene group of from 450 to 1200 molecular weight.

5. The transmission oil composition of claim 1 wherein the succinimide dispersant is derived from a polyisobutylene group of from 750 to 1000 molecular weight.

6. The transmission oil composition of claim 1 further comprising a detergent selected from sulfonate, phenate, or a mixture thereof.

7. The transmission oil composition of claim 1 further comprising a friction modifier.

8. The transmission oil composition of claim 7 wherein the friction modifier is a fatty acid amide.

9. The transmission oil composition of claim 1 wherein the succinimide dispersant is present from 1 to 20 wt. % in the transmission oil composition.

10. A method for lubricating the transmission of a construction machine comprising lubricating the transmission with a Zinc-free transmission oil composition comprising:

(a) a major amount of an oil of lubricating viscosity, (b) at least 0.25 wt. % of a dithiophosphorylated carboxylic acid compound, wherein the dithiophosphorylated carboxylic acid is 3-[[bis(2-methylpropoxy)phosphinothioyl]thio]-2-methyl-propanoic acid, and (c) a succinimide dispersant derived from a polyisobutylene group of 1200 molecular weight or less.

11. The method of claim 10 wherein the dithiophosphorylated carboxylic acid compound is present at 0.25 to 2 wt. %.

12. The method of claim 10 wherein the dithiophosphorylated carboxylic acid compound is present at 0.25 to 1 wt. %.

13. The method of claim 10 wherein the succinimide dispersant is derived from a polyisobutylene group of 450-1200 molecular weight.

14. The method of claim 10 wherein the succinimide dispersant is derived from a polyisobutylene group of 750 to 1000 molecular weight.

15. The method of claim 10 further comprising a detergent selected from sulfonate, phenate, or a mixture thereof.

16. The method of claim 10 further comprising a friction modifier.

17. The method of claim 10 wherein the friction modifier is a fatty acid amide.

* * * * *